US012228015B2

(12) United States Patent
Al-Mousa et al.

(10) Patent No.: US 12,228,015 B2
(45) Date of Patent: Feb. 18, 2025

(54) ADJUSTABLE BRUSH PLUG DEVICE

(71) Applicant: SAUDI ARABIAN OIL COMPANY, Dhahran (SA)

(72) Inventors: Ahmed A. Al-Mousa, Doha (SA); Marius Neacsu, Dhahran (SA); Omar M. Alhamid, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/050,390

(22) Filed: Oct. 27, 2022

(65) Prior Publication Data

US 2024/0141755 A1 May 2, 2024

(51) Int. Cl.
*E21B 37/00* (2006.01)
*E21B 31/00* (2006.01)

(52) U.S. Cl.
CPC ..... *E21B 37/00* (2013.01); *E21B 31/00* (2013.01)

(58) Field of Classification Search
CPC ..... E21B 37/02; E21B 37/00; E21B 17/006; E21B 37/08; E21B 37/10
See application file for complete search history.

(56) References Cited

U.S. PATENT DOCUMENTS 6,464,010 B1 * 10/2002 Brown ..... E21B 37/02 166/173
9,140,100 B2 9/2015 Daccord et al.
9,470,065 B2 10/2016 Kruger et al.
2006/0081375 A1 4/2006 Ruttley
2010/0186962 A1 * 7/2010 Knobloch ..... E21B 37/02 166/170
2014/0000900 A1 * 1/2014 Leiper ..... E21B 17/04 166/173

FOREIGN PATENT DOCUMENTS

AU 2008202960 B2 * 2/2011 ..... E21B 17/046
AU 2014323242 B2 2/2017
CA 2731656 C 9/2017
GB 2499953 A * 9/2013 ..... E21B 17/10
RU 2271439 C2 3/2006
WO WO-03093635 A1 * 11/2003 ..... E21B 17/1014
WO 2009108068 A1 9/2009
WO WO-2009113863 A1 * 9/2009 ..... B08B 9/0436
WO WO-2022187204 A1 * 9/2022 ..... E21B 17/1057

* cited by examiner

*Primary Examiner* — Zakiya W Bates
(74) *Attorney, Agent, or Firm* — Osha Bergman Watanabe & Burton LLP

(57) ABSTRACT

A device for cleaning a tubular of a wellbore includes a cylindrical body. The cylindrical body has a fishing neck, an upper chamber, a lower chamber, a first spring, a second spring, and a rod. The fishing neck facilitates raising and lowering the device within the tubular. The upper chamber receives a latching dog that abuts against the tubular when the device is raised and lowered within the tubular. The lower chamber receives a brush with bristles that scour a surface of the tubular as the device is lowered. The first spring exerts a force between the latching dog and the cylindrical body, while the second spring exerts a force between the brush and the cylindrical body. Finally, the rod interconnects the latching dog and the brush such that the rod forces the brush to withdraw into the cylindrical body when the latching dog actuates away from the cylindrical body.

14 Claims, 4 Drawing Sheets

ADJUSTABLE BRUSH PLUG DEVICE

BACKGROUND

Commercially, wells are commonly used to transmit oil from below the surface of the Earth up to a drilling rig. Once drilled, oil is lifted from the wellbore to the surface through a tubular or other production tubing. During this process, particulate that is stored in the oil may be transferred to the inner surface of the tubular due to a change in temperature, pressure, or other wellbore operating conditions. Over time, the transferred particulate accumulates on the interior of the tubular, causing the internal diameter of the tubular to shrink and the overall efficiency of the well drilling system to decrease. Furthermore, accumulated scaling can inhibit tubing plugs from passing through or setting correctly within the tubular.

Removing scaling from production tubing can prove to be a challenging and costly endeavor. The process of removing scaling typically requires separate drilling runs to clean out and plug a well, which increases the cost of maintaining a wellbore due to the increased system runtime. The separate drilling runs also force the operation to take a significant amount of time, as the device used to clean the wellbore must be interchanged for a dedicated plug for the wellbore.

SUMMARY

A device for cleaning a tubular of a wellbore includes a cylindrical body. The cylindrical body has a fishing neck, an upper chamber, a lower chamber, a first spring, a second spring, and a rod. The fishing neck facilitates raising and lowering the device within the tubular. The upper chamber receives a latching dog that abuts against the tubular when the device is raised and lowered within the tubular. The lower chamber receives a brush with bristles that scour a surface of the tubular as the device is lowered. The first spring exerts a force between the latching dog and the cylindrical body, while the second spring exerts a force between the brush and the cylindrical body. Finally, the rod interconnects the latching dog and the brush such that the rod forces the brush to withdraw into the cylindrical body when the latching dog actuates away from the cylindrical body.

A system includes a tubular configured to deliver fluid from a wellbore to a well site, a device including a cylindrical body, a slickline, and a slickline drum. The cylindrical body of the device has a fishing neck, an upper chamber, a lower chamber, a first spring, a second spring, and a rod. The fishing neck facilitates raising and lowering the device within the tubular. The upper chamber receives a latching dog that abuts against the tubular when the device is raised and lowered within the tubular. The lower chamber receives a brush with bristles that scour a surface of the tubular as the device is lowered. The first spring exerts a force between the latching dog and the cylindrical body, while the second spring exerts a force between the brush and the cylindrical body. Finally, the rod interconnects the latching dog and the brush such that the rod forces the brush to withdraw into the cylindrical body when the latching dog actuates away from the cylindrical body. The slickline of the system includes a fishing attachment configured to attach to the fishing neck of the device, and the slickline drum coils and uncoils the slickline, which causes the device to be raised and lowered within the tubular.

A method for cleaning a tubular of a wellbore includes attaching a fishing attachment of a slickline to a fishing neck of a cylindrical body of a device for cleaning the tubular. The method further includes uncoiling the slickline from a slickline drum, which lowers the device into the tubular. Subsequently, a force is exerted between a latching dog and the cylindrical body that causes the latching dog to abut against the tubular. A second force is exerted on a brush with bristles that is interconnected to the latching dog. As the device is lowered, the bristles scour a surface of the tubular. When the latching dog actuates away from the cylindrical body, the brush is withdrawn into the cylindrical body. Finally, the method includes coiling the slickline onto the slickline drum, which raises the device out of the tubular.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Figure 1:
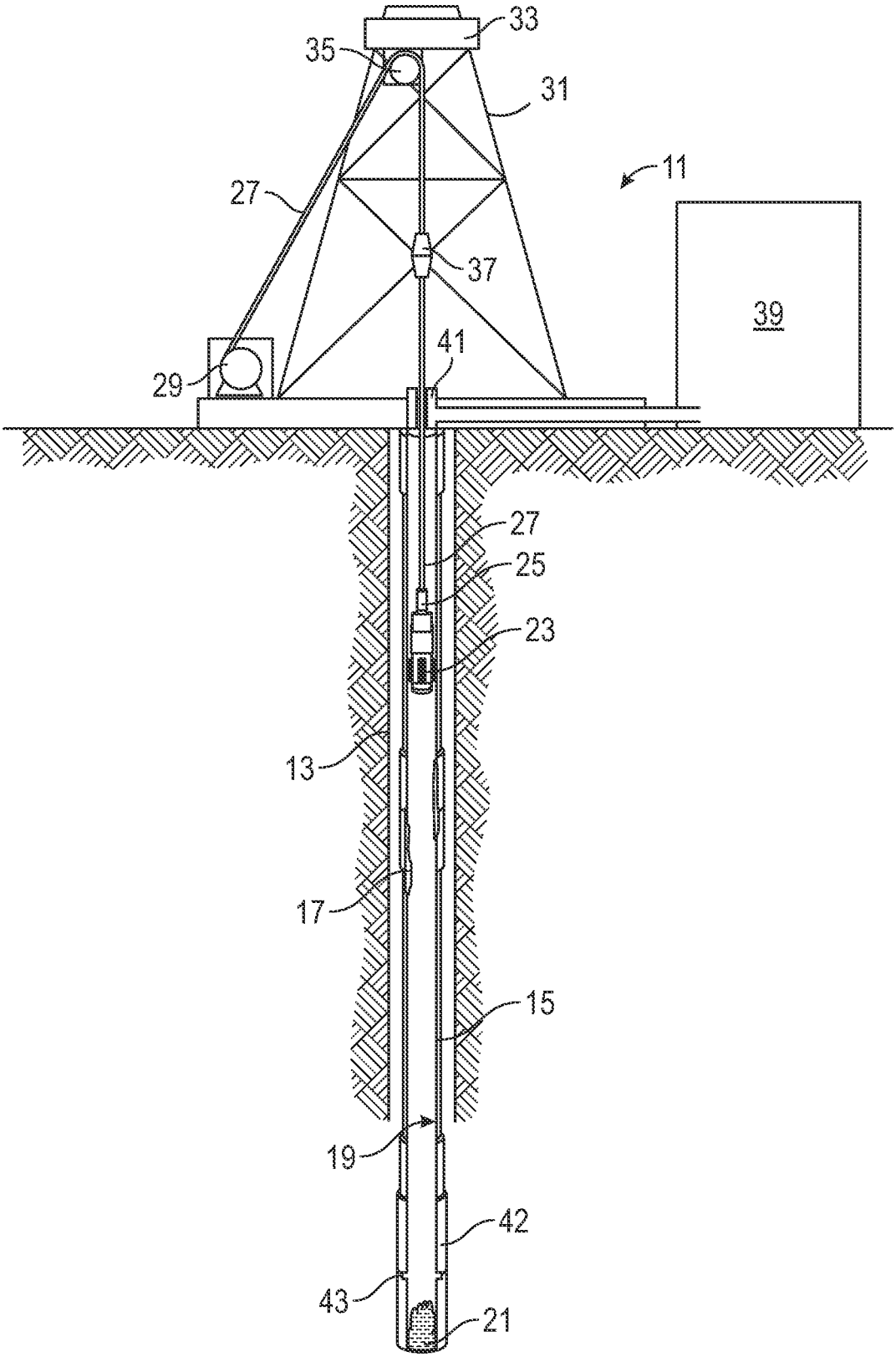
FIG. 1 depicts a well site in accordance with one or more embodiments of the invention.

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a wellbore as described herein. In this respect, the term "upper" denotes an element disposed closer to the surface of the Earth than a corresponding "lower" element when the device is in the wellbore, while the term "lower" conversely describes an element disposed further from the surface of the Earth than a corresponding "upper" element.

Likewise, the term "axial" refers to an orientation substantially parallel to an extension direction of a tubular, while the term "radial" denotes a direction orthogonal to an axial direction.

In general, one or more embodiments of the disclosure are directed towards an adjustable brush and plug device that combines components useful for removing scaling from the side of a wellbore with components useful for sealing a wellbore. During the process of drilling a wellbore and as discussed above, particulates accumulate on the inner surface of the tubular. The particulates may include, for example, calcium carbonate (limescale), iron sulfides, barium sulfate, strontium sulfate, or similar minerals. Due to being trapped below the surface of the Earth under high temperatures and pressures, the particulates are initially dissolved in the oil or other production fluids stored within the wellbore. As the oil is lifted from the wellbore, the temperature and pressure of the oil decreases, which causes the previously dissolved particulates to precipitate and accumulate on the sides of the tubular. As the scaling accumulates, the tubular may become closed off, preventing oil from being lifted from the wellbore.

To assist with removing the scaling, the present invention includes a device with a brush that has a series of bristles, as well as a fishing neck that attaches to a slickline, and a latching dog that interfaces with a landing nipple of the tubular. The fishing neck allows a fishing attachment at the end of a slickline or wireline to be attached to the device, which allows the device to be lowered within the wellbore. As the device is lowered within the tubular, the brush and bristles abut against the side of the tubular, and the bristles of the brush agitate the scaling. The agitated scaling detaches from the tubular and returns to the production fluids, thereby descaling the tubular. Once the device reaches a landing nipple or other enlarged part of the tubular, the latching dogs extend into the enlarged portion, which causes the brush to withdraw into the device.

FIG. 1 depicts a well site 11 for performing drilling operations in accordance with one or more embodiments of the invention. In general, well sites may be configured in a myriad of ways. Therefore, well site 11 is not intended to be limiting with respect to the particular configuration of the drilling equipment. The well site 11 is depicted as being on land. In other examples, the well site 11 may be offshore, and drilling may be carried out with or without the use of a marine riser.

A drilling operation at a well site 11 includes drilling a wellbore 13 into a subsurface. Once the drilling operation is complete, the wellbore 13 is finalized by placing a tubular 15 into the wellbore 13, which is a pipe that supports the structure of the wellbore 13 and prevents the wellbore 13 from collapsing upon itself. The tubular 15 is formed from high strength steel, a composite alloy, or equivalent, and may be referred to as a "production tubing," "production casing," "tubing string," or other associated phrases without departing from the scope of the invention.

As shown in FIG. 1, the well site 11 is formed by several components that serve to raise and lower objects, sensors, devices, productions fluids, drilling fluids, and other items into and out of the tubular 15. More specifically, objects are raised and lowered into and out of the tubular 15 through a slickline 27, which is a steel alloy or equivalent single strand wire that is coiled around a slickline drum 29. The slickline drum 29 includes a motor (not shown), and when the motor actuates the slickline 27 is coiled or uncoiled from the slickline drum 29.

The slickline 27 is supported by a derrick 31, which is a hoisting device that supports and distributes various mechanical loads at the well site 11. The derrick 31 also includes a crown block 33, which is a stationary component of the derrick 31 that supports a pulley 35. The pulley 35 routes the slickline 27 from the slickline drum 29 into the wellbore 13. The slickline 27 also includes a load cell 37, which measures the amount of tensive force being applied to the slickline 27 as is commonly known in the art.

The well site 11 also includes components configured to deliver fluid to and from the wellbore 13. In particular, the well site 11 includes a mud system 39, such as a pump and reservoir, that deliver fluids to a Blow Out Preventer (BOP) 41 of the well site 11. The BOP 41 caps the tubular 15 to prevent contaminants from entering the wellbore 13, and includes piping rams (not shown) that close off a tubular if the integrity or function of the well site 11 becomes compromised.

As seen in FIG. 1, the tubular 15 has scaling 17 on its internal diameter 19, which inhibits production fluids 21 from traveling up the tubular 15. To remove the scaling 17 from the tubular 15, a plug device 23 is lowered using a fishing attachment 25, such as a pulling tool or equivalent, of the slickline 27. Drilling mud or other fluids are pumped in the tubular 15 in the space above the plug device 23, which provides additional force to assist with driving the plug device 23 down the wellbore 13. The plug device 23 includes one or more brushes that each include a series of bristles (e.g., FIG. 2), and the bristles abut against the internal diameter 19. As the plug device 23 is lowered through the tubular 15, the bristles scour the surface of the scaling 17, which is deposited into the production fluids 21 below the plug device 23. The plug device 23 is then lowered through the tubular 15 to a landing nipple 43 of the tubular 15, which is a machined surface of an enlarged section, or landing profile 42, of the tubular 15 that provides a sealing interface for components of the well site 11 to attach to.

Once the plug device 23 reaches the landing nipple 43, one or more latching dogs (e.g., FIG. 2) extend from the plug device 23 into the landing nipple 43 of the tubular 15. The plug device 23 is thus retained in the landing nipple 43, and is unable to be driven or lowered further into the wellbore 13. At this point, the extension of the latching dog (e.g., FIG. 2) causes the brushes to withdraw into the plug device 23. With the brushes withdrawn into the plug device 23, the plug device 23 functions as a plug that caps the tubular 15 to prevent the production fluids 21 from escaping the tubular 15. Accordingly, the present invention only requires a single run to both descale and plug the wellbore 13. Once the plug device 23 is set within the landing nipple 43, the fishing attachment 25 of the slickline 27 is detached from the plug device 23 and the slickline 27 is coiled back into the slickline drum 29. The plug device 23 is then retrieved at a later time using the slickline 27 by relowering the slickline 27 into the wellbore 13, fishing the plug device 23 with the fishing attachment 25, and recoiling the slickline 27 into the slickline drum 29.

Figure 2:
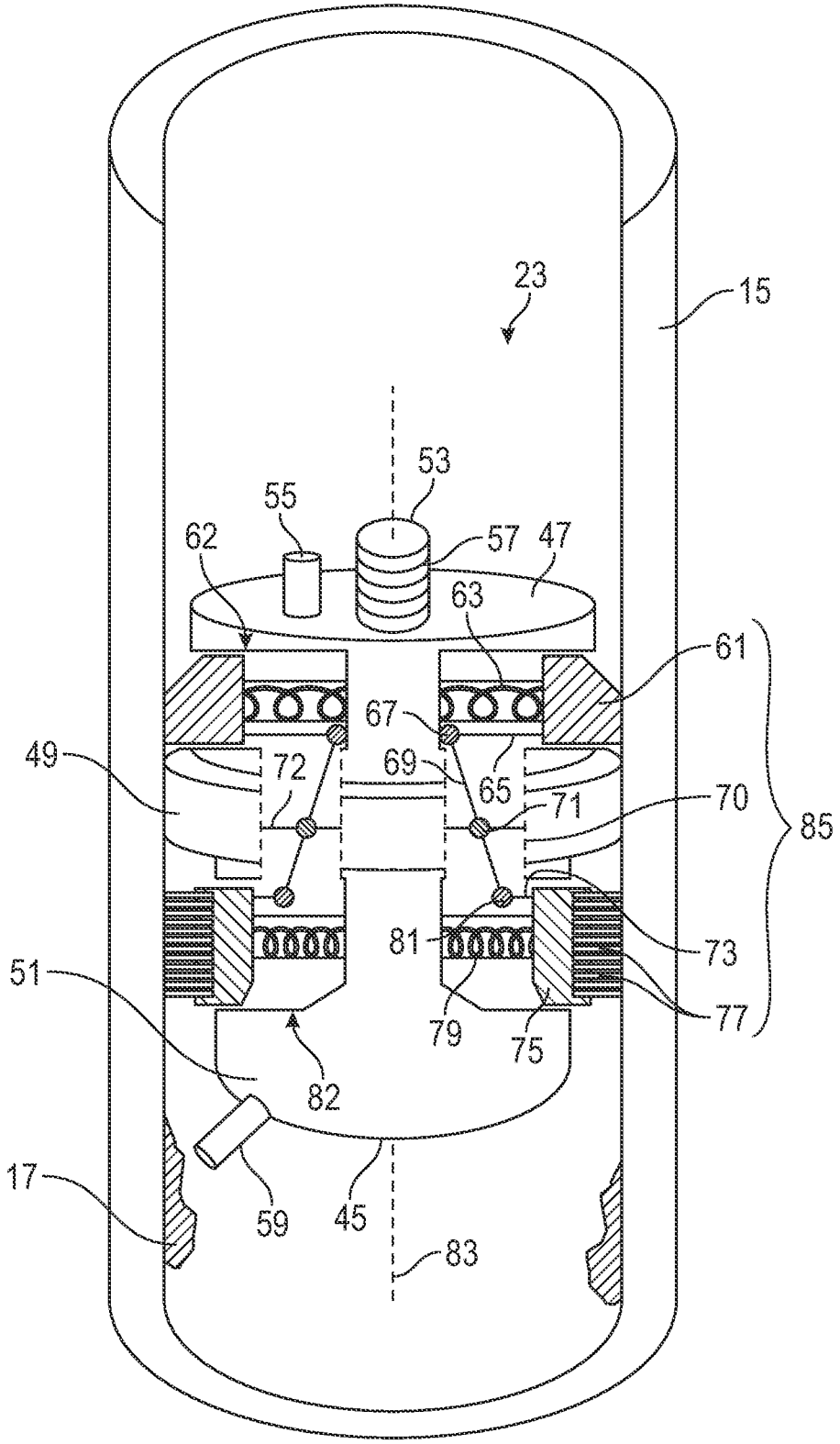
FIG. 2 depicts a device for cleaning a tubular of a wellbore in accordance with one or more embodiments of the invention.

FIG. 2 depicts a plug device 23 consistent with one or more embodiments of the invention. As shown in FIG. 2, the plug device 23 is primarily formed of a cylindrical body 45 including an upper section 47, a middle section 49, and a lower section 51 that primarily extend in an axial direction and may be formed of steel, iron, an alloy, or equivalent. The upper section 47 includes a fishing neck 53 and an equalization inlet port 55. The fishing neck 53 is an extension of the cylindrical body 45, and is formed with a series of spiralized ridges 57 that provide a gripping surface for the fishing attachment 25 to act upon, which facilitates removing the plug device 23 from the wellbore 13. The spiralized ridges 57 and fishing neck 53 may be machined, for example, by a lathe, and the fishing neck 53 may alternatively be brazed or welded to the upper section 47 of the cylindrical body 45.

The equalization inlet port 55 is a pipe or similar tubular structure that extends from the uppermost axial surface of the upper section 47 through the cylindrical body 45, until the equalization inlet port 55 joins an equalization outlet port 59 disposed in the lower section 51. During the process of lowering the plug device 23 in the tubular 15, fluid is pumped by the mud system 39 above the plug device 23 to force the plug device 23 to actuate through portions of the tubular 15 that have scaling 17. Upon reaching the equalization outlet port 59, the fluid is dispensed into the portion of the tubular 15 below the plug device 23. The equalization inlet port 55 serves to transport the fluid through the cylindrical body 45, which prevents the tubular 15 from becoming over pressurized during the descaling process and prevents the plug device 23 from getting stuck on scaling 17 while being run in the tubular 15. The size of the equalization inlet port 55 and the equalization outlet port 59 are determined according to the anticipated pressure and force developed above the plug device 23, which includes hydrostatic pressure and force from the fluid column as well as pressure and force from the mud system 39.

Also included in the upper section 47 of the plug device 23 is a latching dog 61, which extends from the cylindrical body 45 to abut against the tubular 15. The latching dog 61 is connected to the cylindrical body 45 with a first spring 63, which biases the latching dog 61 against the tubular 15, and allows the radial position of the latching dog 61 to fluctuate according to the internal diameter 19 of the tubular 15. The latching dog 61 is formed in the shape of a rectangular prism or a half cylinder, for example, and may be formed of steel or an equivalent alloy.

To retain the latching dog 61 in an axial direction, the latching dog 61 is configured with a first connecting shaft 65, which is a steel or equivalent shaft that extends from the latching dog 61 at one end to a first bearing 67 at its other end. The latching dog 61, the first spring 63, the first connecting shaft 65, and the first bearing 67 are each disposed in an upper chamber 62, which is a cutout formed in the upper section 47 of the cylindrical body 45 to house the aforementioned components.

In the embodiment depicted in FIG. 2, the first connecting shaft 65 is cylindrically formed of a single piece of metal, such as steel, iron, an alloy, or equivalent. The first connecting shaft 65 may be either solid or tubular in nature, and may include any number of weight reduction features such as dimples or cutouts. Alternatively, the first connecting shaft 65 may be embodied as a telescopic shaft formed of interconnected pieces that slide past each other. In this case, the individual sections of the first connecting shaft 65 are nested within each other when the first connecting shaft 65 abuts against the tubular 15, and the first connecting shaft 65 successively lengthens as the latching dog 61 is actuated.

To actuate the first connecting shaft 65, the first connecting shaft 65 is connected to a rod 69 that extends from the upper section 47 of the cylindrical body 45 to the lower section 51 of the cylindrical body 45. The rod 69 is similar in form to the first connecting shaft 65, and is formed as a rigid column of metal that may include weight reduction features as described above. The rod 69 is connected to the cylindrical body 45 by a pivot connection 71, which is embodied as a pin joint or pivot pin that is disposed in the middle section 49. The pivot connection 71 prevents the rod 69 from translating in an axial or radial direction, such that the rod 69 is solely limited to rotational movement. As the rod 69 freely rotates about the pivot connection 71, the first bearing 67 rotates with the rod 69 and transfers the rotational motion of the rod 69 to the first connecting shaft 65. The first connecting shaft 65 then linearly actuates according to the motion from the rod 69, which forces the latching dog 61 to linearly actuate as well.

The rod 69 extends through a central passage 70, which is a bore that extends in an axial direction through the cylindrical body 45. The central passage 70 is sized to accommodate the rod 69 as the rod 69 rotates about the pivot connection 71. Additionally, the central passage 70 includes a seal 72 that is formed at the pivot connection 71 that prevents production fluids 21 from traveling up the central passage 70 into the tubular 15. The seal 72 may be formed of rubber or a similar elastomer, a steel or similar alloy, or a combination thereof.

In the lower section 51 of the cylindrical body 45, the rod 69 connects to a second connecting shaft 73 that connects to a brush 75 that includes a series of bristles 77. The second connecting shaft 73 is actuated by a second spring 79, which provides a compressive force on the brush 75 that abuts the bristles 77 against the tubular 15. In addition, the second connecting shaft 73 is attached to the rod 69 via a second bearing 81. Thus, both the first connecting shaft 65 and the second connecting shaft 73 are connected to the rod 69, which, in turn, interconnects the motion of the latching dog 61 to the motion of the brush 75 and the bristles 77. Similar to the latching dog 61 and its associated components, the brush 75, the second connecting shaft 73, the second bearing 81, and the second spring 79 are retained within a lower chamber 82, which is a cutout formed in the lower section 51 of the cylindrical body 45.

The length of the first connecting shaft 65, the rod 69, and the second connecting shaft 73 depends on the distance between the upper section 47 and the tubular 15, as well as the distance between the lower section 51 and the tubular 15. Specifically, and as shown in FIG. 2, the latching dog 61 is configured to abut against the tubular 15 simultaneous to the bristles 77 abutting against the tubular 15 as well. Thus, the lengths of the first connecting shaft 65, the rod 69, and the second connecting shaft 73 depend on the distance that the latching dog 61 and bristles 77 of the brush 75 must each extend to simultaneously contact the tubular 15.

The actuation of the first connecting shaft 65, the rod 69, and the second connecting shaft 73 is further facilitated by the first spring 63 and the second spring 79. As noted above, the first spring 63 is fixed at one end to the cylindrical body 45, and is fixed at its other end to the latching dog 61 such that the first spring 63 connects the latching dog 61 to the cylindrical body 45. In addition, the first spring 63 is also in compression throughout the entirety of the extension of the latching dog 61, which forces the latching dog 61 to constantly remain in contact with the tubular 15. The second spring 79 similarly connects the brush 75 to the cylindrical body 45. However, the second spring 79 has a spring force (compressive or tensive) that is less than that of the compressive spring force output by the first spring 63. As such, the overall actuation of the plug device 23 is driven by the first spring 63, while the second spring 79 aids in the withdrawal of the brush 75.

The combination of (i) simultaneous contact between the latching dog 61 and the tubular 15 and the brush 75 and the tubular 15 and (ii) the actuation from the first spring 63 and the second spring 79 assists with scouring the surface of the tubular 15. As the plug device 23 is lowered into the tubular 15 and contacts the scaling 17, the brush 75 will attempt to withdraw into the cylindrical body 45. However, the forces from the first spring 63 and the rod 69 only allow the brush 75 to partially withdraw into the plug device 23, while still forcing the bristles 77 to maintain contact with the scaling 17. Thus, the bristles 77 are actively forced by the first spring 63 and rod 69 to scour the scaling 17, which advantageously causes scaling 17 to be removed from the surface of the tubular 15.

In addition to the bristles 77, the middle section 49 also removes scaling 17 from the sides of the tubular 15. Specifically, the middle section 49 has an outer diameter that matches and abuts against the internal diameter 19 of the tubular 15 such that the middle section 49 fluidly seals a portion of the tubular 15 above the plug device 23 from a portion of the tubular 15 below the plug device 23. As the plug device 23 is driven down the tubular 15, any scaling 17 that is not removed by the bristles 77 is removed from the tubular 15 by the middle section 49. In the event that the bristles 77 are unable to sufficiently remove the scaling 17 from the tubular 15, the middle section 49 of the cylindrical body 45 abuts against the scaling 17, and a fluid column (not shown) develops above the plug device 23. The additional weight of the fluid column (not shown) acting on the plug device 23 causes the middle section 49 to scrape the remainder of the scaling 17 from the tubular 15.

Due to the equalization inlet port 55 and the equalization outlet port 59, pressure in the wellbore 13 is stabilized even with the additional weight of the fluid column (not shown). That is, the diameter of the equalization inlet port 55 and the equalization outlet port 59 are sized according to the anticipated shearing force required to remove the scaling 17 from the wellbore 13 in conjunction with the required weight of the fluid column and the plug device 23. Thus, overall, the combination of the bristles 77 of the brush 75 and the middle section 49 of the cylindrical body 45 force the scaling 17 to be completely removed from the tubular 15. Furthermore, because the latching dog 61 is disposed above the middle section 49 relative to the scaling 17, the scaling 17 does not interfere with the actuation of the latching dog 61.

Overall, the combination of the latching dog 61, the first spring 63, the first connecting shaft 65, the first bearing 67, the rod 69, the pivot connection 71, the seal 72 the second connecting shaft 73, the brush 75 and bristles 77, the second spring 79, and the second bearing 81 form constituent components of one descaling mechanism 85 for descaling the tubular 15. However, while the aforementioned descaling mechanism 85 and its constituent components have been described in the singular form thus far, the plug device 23 is formed of multiple descaling mechanisms 85 disposed at different radial positions in the cylindrical body 45. That is, and as seen in FIG. 2, the constituent components of a first descaling mechanism 85 are disposed on the right hand side of a vertical axis 83, while a second descaling mechanism 85 is disposed diametrically opposed to the first descaling mechanism 85 on the left hand side of the vertical axis 83.

Although not shown, a plug device 23 may be configured with any number of descaling mechanisms 85, which may be disposed in diametrically opposed pairs or evenly spaced in a radial direction in the cylindrical body 45. While a greater number of descaling mechanisms 85 allows the plug device 23 to be better stabilized within the tubular 15 and produce a cleaner wellbore 13, each descaling mechanism 85 increases the production cost of a plug device 23. As such, the number of descaling mechanism(s) 85 is not necessarily limited to a particular number of descaling mechanism(s) 85, and may include a singular descaling mechanism 85 or a plurality of descaling mechanisms 85.

Figure 3:
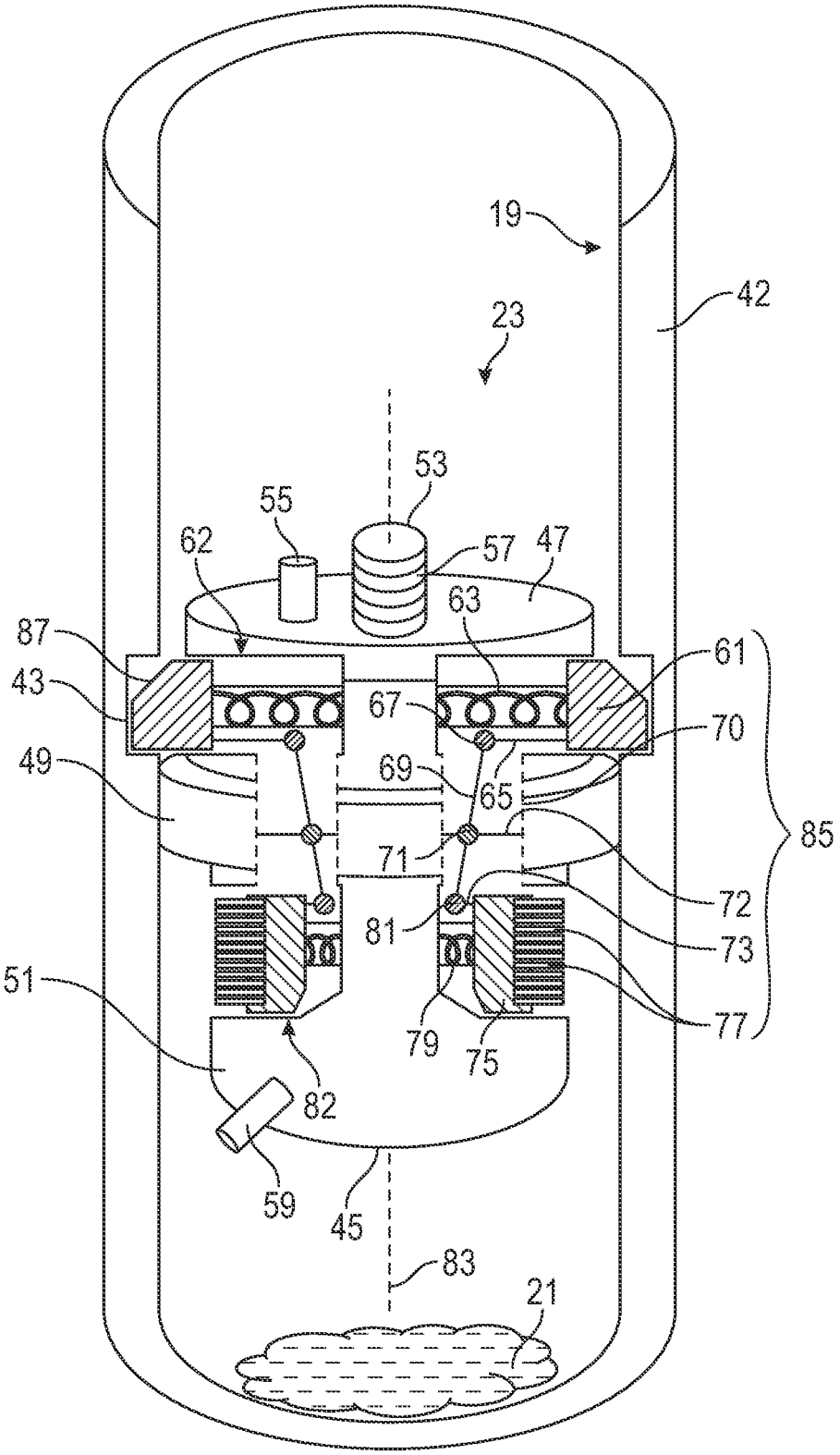
FIG. 3 depicts a second device for cleaning a tubular of a wellbore in accordance with one or more embodiments of the invention.

Turning to FIG. 3, FIG. 3 depicts a series of descaling mechanisms 85 that are actuated into a second position where each latching dog 61 extends into the landing nipple 43. As shown in FIG. 3, the first spring 63 has elongated, and part of the compressive force of the first spring 63 has been transferred to the latching dog 61, which forces the latching dog 61 into the landing nipple 43. The actuation of the latching dog 61 away from the cylindrical body 45 causes the rod 69 to rotate due to the first connecting shaft 65, pivot connection 71, and first bearing 67 as described above. This actuation, in turn, causes the second connecting shaft 73 to pull the brush 75 and bristles 77 into the lower chamber 82 of the cylindrical body 45.

With the latching dog 61 in the extended position, the plug device 23 functions as a plug for the wellbore 13. More specifically, due to the fact that the middle section 49 of the cylindrical body 45 has a diameter that matches the internal diameter 19 of the tubular 15, any production fluids 21 are prevented from traveling up the tubular 15. To aid with preventing fluid travel, the middle section 49 may be covered with a rubber or other elastic polymer over mold (not shown) that forms a seal between the middle section 49 and the tubular 15. In addition, the equalization outlet port 59 may be configured with a check valve (not shown) disposed therewithin, which prevents production fluids 21 from travelling into the tubular 15 via the equalization inlet port 55. Alternatively, the equalization outlet port 59 may include a butterfly valve, controlled at the surface, that is opened or closed at an operator's discretion, or according to whether the plug device 23 is in the landing profile 42.

As noted above, the first spring 63 is in compression regardless of whether the latching dog 61 abuts against the tubular 15 or extends into the landing nipple 43. This prevents the brush 75 from extending from the cylindrical body 45, regardless of whether production fluids 21 enter the lower chamber 82 of the cylindrical body 45. Furthermore, the constant compressive force from the first spring 63 retains the latching dog 61 within the landing nipple 43. This causes the latching dog 61 to act as a hanger that keeps the cylindrical body 45 retained in an axial direction with respect to the wellbore 13, and the cylindrical body 45 abuts against the latching dog 61 during the plugging process.

To withdraw the plug device 23 from the landing nipple 43, the latching dog 61 includes a bevel 87 on its upper axial edge. Because the latching dog 61 is formed of metal or equivalent as described above, the bevel 87 is formed as part of the casting process, or machined into the latching dog 61 after the latching dog 61 is formed. As the fishing attachment 25 (i.e., FIG. 1) grips the spiralized ridges 57 of the fishing neck 53, the slickline 27 is reeled in by the slickline drum 29, which abuts the bevel 87 against the landing nipple 43. This causes a force that acts in a normal direction to the bevel 87, and the radial component of the force causes the latching dog 61 to withdraw into the upper chamber 62. Therefore, the bevel 87 facilitates the withdrawal of the latching dog 61 into the upper chamber 62 of the cylindrical body 45, and enables the plug device 23 to be drawn up the tubular 15 to the surface of the earth at the well site 11 (i.e., FIG. 1).

Figure 4:
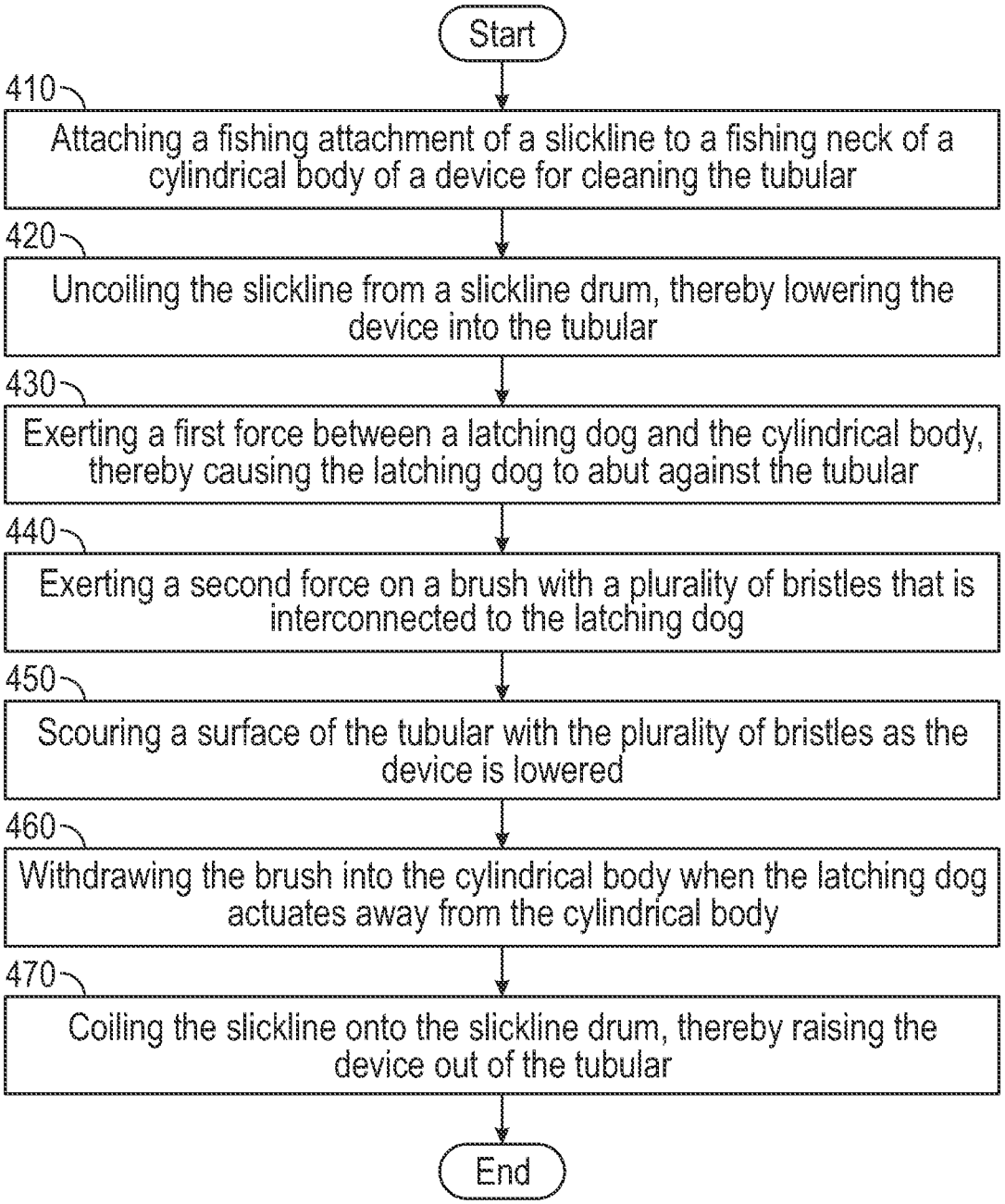
FIG. 4 depicts a flowchart of a method in accordance with one or more embodiments of the present disclosure.

FIG. 4 is a method for cleaning a wellbore consistent with one or more embodiments of the invention as described herein. Steps of FIG. 4 may be performed, for example, by the aforementioned components of a plug device 23, but is not limited thereto. The constituent steps of the method depicted in FIG. 4 may be performed in any logical order, and is not limited to the sequence presented.

The method initiates with step 410, where a fishing attachment 25 of a slickline 27 is attached to a fishing neck 53 of a plug device 23. The fishing attachment 25 is attached to the slickline 27 at the surface of the earth at a well site 11, and may be attached manually by an operator. Once the slickline 27 is coupled to the plug device 23, the method proceeds to step 420.

In step 420, the slickline 27 is uncoiled from a slickline drum 29 of the well site 11. This causes the plug device 23 to be lowered through a Blow Out Preventer (BOP) 41, and into a tubular 15 of a wellbore 13. As the slickline 27 is uncoiled and the plug device 23 is lowered, fluid is pumped into the tubular 15 in the space above the plug device 23, which forms a fluid column above the plug device 23. This fluid column causes the plug device 23 to be driven down the tubular 15, and allows the plug device 23 to be forcibly driven through any scaling 17 that accumulates on the tubular 15. Fluid is delivered to the BOP 41 and the tubular 15 via the mud system 39, which is a reservoir, pump, and other components necessary to move drilling fluid from the well site 11 to the wellbore 13. As the plug device 23 is lowered into the wellbore 13, the method proceeds to step 430, where the plug device 23 is actuated.

During step 430, a first spring 63 exerts a force onto a latching dog 61 while the plug device 23 is lowered into the tubular 15. This force causes the latching dog 61 to extend out of an upper chamber 62 of a cylindrical body 45 of the plug device 23 and abut against the tubular 15. This force also assists with stabilizing the plug device 23 within the wellbore 13, as the latching dog 61 prevents the plug device 23 from rotating within the wellbore 13 if the plug device 23 encounters scaling 17.

In step 440, a second spring 79 exerts a force on a brush 75, with a plurality of bristles 77, that is interconnected to the latching dog 61. More specifically, a rod 69 connects (via a first bearing 67 and a second bearing 81) to a first connecting shaft 65 and a second connecting shaft 73, which connect to the latching dog 61 and the brush 75, respectively. The rod 69 rotates about a pivot connection 71 and causes the latching dog 61 to actuate opposite of the brush 75, such that the latching dog 61 withdraws into the cylindrical body 45 when the brush 75 extends away from the cylindrical body 45, and vice versa. The aforementioned collection of components of the plug device 23 forms one descaling mechanism 85, and a plug device 23 may be configured with any number of descaling mechanisms 85.

Returning to the second spring 79, the second spring 79 extends between the cylindrical body 45 and the brush 75, and provides force therebetween. This second force is less than the first force provided by the first spring 63 that extends between the latching dog 61 and the cylindrical body 45, and assists with the withdrawal and extension of the brush 75 from the cylindrical body 45. The brush 75 may be forced to withdraw into the cylindrical body 45 due to excessive scaling 17, for example, in which case the second spring 79 counteracts the force provided by the first spring 63. Furthermore, because the motion of the brush 75 is tied to motion of the latching dog 61 as described above, the second spring 79 dampens the motion of withdrawing the brush 75 into the lower chamber 82 of the cylindrical body 45. Finally, the second spring 79 is rigid in nature such that the second spring 79 assists in retaining the brush 75 in an axial direction relative to the cylindrical body 45, which further aids in descaling the tubular 15.

In step 450, an inner surface of the tubular 15 is scoured by the plurality of bristles 77 of the brush 75 as the plug device 23 is lowered through the tubular 15. More specifically, the rod 69, the first connecting shaft 65, and the second connecting shaft 73, are sized such that the latching dog 61 and the bristles 77 simultaneously abut against the tubular 15, while a first spring 63 provides a compressive force that acts on the latching dog 61 and the cylindrical body 45. As the plug device 23 is lowered, the bristles 77 scour the sides of the tubular 15, which causes scaling 17 to be deposited into the wellbore 13. If the bristles 77 are unable to easily remove the scaling 17, then the latching dog 61 and its associated force from the first spring 63 provide additional force to the bristles 77, which aid in further removing the scaling 17. Furthermore, if this process is unsuccessful, the scaling 17 is scraped from the sides of the tubular 15 by a middle section 49 of the cylindrical body 45, which is an enlarged section thereof. As the middle section 49 abuts against the scaling 17, a fluid column develops above the plug device 23, and any remaining scaling 17 is removed by the middle section 49 as described above. Thus, overall, the bristles 77 and the middle section 49 descale the tubular 15 completely as the plug device 23 is lowered in the wellbore 13. The plug device 23 is lowered through the tubular 15 until it reaches the landing nipple 43, where the method proceeds to step 460.

In step 460, the latching dog 61 actuates away from the cylindrical body 45 into the landing nipple 43, which causes the brush 75 and bristles 77 to withdraw into the cylindrical body 45. The latching dog 61 prevents the cylindrical body 45 from being further lowered into the tubular 15, as any further attempts to lower the plug device 23 results in the upper chamber 62 of the cylindrical body 45 abutting against the latching dog 61. In this position, the plug device 23 functions as a temporary tubing plug that prevents fluid from traveling up the tubular 15. The amount of time that the plug device 23 functions as a tubing plug depends upon an operator's discretion and/or the use case of the wellbore 13. Once the plug device 23 is ready to be removed from the wellbore 13, the method proceeds to step 470.

In step 470, the slickline 27 is coiled back into the slickline drum 29, and the plug device 23 is lifted from the wellbore 13. To facilitate the withdrawal of the latching dog 61 into the cylindrical body 45, the latching dog 61 includes a bevel 87 on its upper outermost edge. When the bevel 87 abuts against a corner or other surface of the landing nipple 43, the surface imparts a force normal to the bevel 87, causing the latching dog 61 to withdraw out of the landing nipple 43 and into the cylindrical body 45. With the latching dog 61 withdrawn from the landing nipple 43, the plug device 23 is freely lifted through the descaled wellbore 13 and returned to the well site 11 to be collected by an operator. The process may be repeated any number of times as the wellbore 13 accumulates scaling 17 or the wellbore 13 needs to be plugged.

Accordingly, the aforementioned embodiments of the invention as disclosed relate to devices and methods useful to reduce the amount of scaling present in a wellbore. In addition, embodiments of the invention are capable of both descaling a tubular and plugging a well in a single trip, which further reduces the cost and time required to complete a plugging operation. Embodiments of the invention also receive the benefit of descaling the tubular immediately prior to sealing the well, which prevents scaling from accumulating in a period of time where a descaling device would otherwise need to be removed to allow a plug to be inserted into the tubular.

Although only a few embodiments of the invention have been described in detail above, those skilled in the art will readily appreciate that many modifications are possible in the example embodiments without materially departing from this invention. For example, a rod may not pivot about a pivot connection, and instead move freely within the cylindrical body, while still interconnecting a latching dog to a brush and bristles. In addition, a brush and a latching dog may not be interconnected, and the latching dog and brush may instead be actuated solely by their respective springs. Moreover, the fishing neck may be formed with a smooth outer surface, which saves on production costs. Accordingly, all such modifications are intended to be included within the scope of this disclosure as defined in the following claims.

What is claimed is:

1. A device for cleaning a tubular of a wellbore, the device comprising:

a cylindrical body comprising:

a fishing neck that is configured to facilitate raising and lowering the device within the tubular;

an upper chamber that receives a latching dog that is configured to abut against the tubular when the device is raised and lowered within the tubular;

a first spring configured to exert a first force between the latching dog and the cylindrical body;

a lower chamber that receives a brush comprising a plurality of bristles fixed thereto that are configured to scour a surface of the tubular as the device is lowered;

a second spring configured to exert a second force between the brush and the cylindrical body;

a rod that interconnects the latching dog and the brush such that the rod forces the brush to withdraw into the cylindrical body when the latching dog actuates away from the cylindrical body, and a pivot connection configured to connect the rod to the cylindrical body, wherein the rod is configured to freely rotate about the pivot connection.

2. The device of claim 1, further comprising:

a first connecting shaft that connects the latching dog to the rod, and a first bearing that connects the first connecting shaft to the rod.

3. The device of claim 2, further comprising:

a second connecting shaft that connects the brush to the rod, and a second bearing disposed that connects the second connecting shaft to the rod.

4. The device of claim 3, where the second spring connects the brush to the cylindrical body.

5. The device of claim 1, further comprising: an equalization inlet port configured to receive fluid disposed in the tubular above the device and transport the fluid through the cylindrical body.

6. The device of claim 1, further comprising: an equalization outlet port configured to dispense fluid from the cylindrical body into the tubular below the device.

7. The device of claim 1, wherein the first spring connects the latching dog to the cylindrical body.

8. The device of claim 1, wherein the cylindrical body comprises an upper section that comprises the latching dog, the upper section being disposed above a lower section of the cylindrical body that comprises the brush.

9. The device of claim 1, wherein the cylindrical body comprises a middle section that is configured to abut against the tubular, thereby fluidly sealing a first portion of the tubular above the device from a second portion of the tubular below the device.

10. The device of claim 1:

wherein the cylindrical body primarily extends in an axial direction parallel to an extension direction of the tubular, and wherein the latching dog and the brush actuate in a radial direction that is orthogonal to the axial direction.

11. The device of claim 1, wherein the latching dog is configured to extend into a landing nipple of the tubular when the latching dog extends away from the cylindrical body.

12. The device of claim 1, wherein the rod is positioned to simultaneously abut the latching dog and the plurality of bristles against the tubular.

13. A system comprising:

a tubular configured to deliver fluid from a wellbore to a well site;

a device comprising:

a cylindrical body comprising:

a fishing neck that is configured to facilitate raising and lowering the device within the tubular;

an upper chamber that receives a latching dog that is configured to abut against the tubular when the device is raised and lowered within the tubular;

a first spring configured to exert a first force between the latching dog and the cylindrical body;

a lower chamber that receives a brush comprising a plurality of bristles fixed thereto that are configured to scour a surface of the tubular as the device is lowered;

a second spring configured to exert a second force between the brush and the cylindrical body;

a rod that interconnects the latching dog and the brush such that the rod forces the brush to withdraw into the cylindrical body when the latching dog actuates away from the cylindrical body, and a pivot connection configured to connect the rod to the cylindrical body, wherein the rod is configured to freely rotate about the pivot connection, a slickline comprising a fishing attachment configured to attach to the fishing neck of the device, and a slickline drum configured to coil and uncoil the slickline, thereby causing the device to be raised and lowered within the tubular.

14. The system of claim 13, wherein the fishing neck comprises a plurality of spiralized ridges that provide a gripping surface for the fishing attachment to act upon.

* * * * *